US006105328A

United States Patent [19]

Hahn

[11] Patent Number: 6,105,328

[45] Date of Patent: Aug. 22, 2000

[54] METHOD AND APPARATUS FOR MANUFACTURING AND INSTALLING ROOF TILES HAVING IMPROVED STRENGTH AND STACKING FEATURES

[75] Inventor: Eric Martin Hahn, Aliso Viejo, Calif.

[73] Assignee: Boral Industries, Inc., Atlanta, Ga.

[21] Appl. No.: 09/087,555

[22] Filed: May 29, 1998

Related U.S. Application Data

[63] Continuation-in-part of application No. 08/711,042, Sep. 10, 1996, which is a continuation-in-part of application No. 29/072,246, Jun. 10, 1997, abandoned.

[60] Provisional application No. 60/073,273, Jan. 30, 1998.

[51] Int. Cl.[7] ..... E04D 1/00

[52] U.S. Cl. ..... 52/518; 52/519; 52/542; 52/557

[58] Field of Search ..... 52/518, 519, 536, 52/541, 542, 557

[56] References Cited

U.S. PATENT DOCUMENTS

| | | | |
|---|---|---|---|
| D. 27,761 | 10/1897 | Mark . | |
| 34,586 | 3/1862 | Mittelhaus . | |
| D. 282,288 | 1/1986 | Bates . | |
| D. 283,551 | 4/1986 | Repasky . | |
| D. 320,091 | 9/1991 | Paquette . | |
| D. 321,942 | 11/1991 | Lynn . | |
| D. 338,541 | 8/1993 | Fifield . | |
| D. 347,483 | 5/1994 | Thomas . | |
| D. 356,873 | 3/1995 | Bamber et al. . | |
| D. 370,539 | 6/1996 | Treat . | |
| 479,442 | 7/1892 | Marvick . | |
| 491,625 | 2/1893 | Wutke . | |
| 1,427,968 | 9/1922 | Pedersen . | |
| 1,454,070 | 5/1923 | Openshaw . | |
| 1,572,377 | 2/1926 | Blair | 52/518 X |
| 1,993,086 | 3/1935 | Chaffee . | |
| 2,340,038 | 1/1944 | Buczkowski et al. . | |
| 2,430,200 | 11/1947 | Wilson . | |
| 2,510,416 | 6/1950 | Pretty . | |
| 2,624,298 | 1/1953 | Farren . | |
| 3,267,823 | 8/1966 | MacRae . | |
| 3,440,777 | 4/1969 | Martin . | |
| 3,579,940 | 5/1971 | Greenleaf . | |

(List continued on next page.)

FOREIGN PATENT DOCUMENTS

| | | | |
|---|---|---|---|
| 70225 | 3/1992 | Canada . | |
| 0088198 A2 | 9/1983 | European Pat. Off. . | |
| 0115374 A2 | 8/1984 | European Pat. Off. . | |
| 0175500 A1 | 3/1986 | European Pat. Off. . | |
| 0236585 A1 | 9/1987 | European Pat. Off. . | |
| 0375802 A1 | 7/1990 | European Pat. Off. . | |
| 1259641 | 8/1961 | France . | |
| 0 095 420 A1 | 11/1983 | France . | |
| 93888 | 12/1896 | Germany . | |
| D-9125 | 6/1990 | Ireland . | |
| 583563 | 10/1958 | Italy | 52/541 |
| 1 569 978 | 6/1989 | Switzerland . | |
| 1 020 013 | of 0000 | United Kingdom . | |
| 416649 | 10/1934 | United Kingdom . | |
| 483969 | 3/1938 | United Kingdom . | |
| 896450 | 6/1960 | United Kingdom . | |
| 995692 | 7/1963 | United Kingdom . | |
| 2046808 | 11/1980 | United Kingdom . | |
| 1586369 | 3/1981 | United Kingdom . | |
| 2111550A | 7/1983 | United Kingdom . | |
| 2123058A | 1/1984 | United Kingdom . | |
| 2178773A | 2/1987 | United Kingdom . | |
| 2245613A | 1/1992 | United Kingdom . | |

*Primary Examiner*—Carl D. Friedman
*Assistant Examiner*—Brian E. Glessner
*Attorney, Agent, or Firm*—Jones & Askew LLP

[57] ABSTRACT

A method and apparatus for manufacturing and installing a roof structure, in which clay is formed into tiles which simulate wood shakes, and the tiles are attached atop a supporting surface in a predetermined manner in a substantially unrecognizable pattern. The tile configuration provides a structure which is light in weight yet is structurally sound, which lends itself to ready installation upon a wide variety of structures. Secondary supporting ribs for strength and upwardly-directed support ridges for improved stackability are also provided.

7 Claims, 16 Drawing Sheets

U.S. PATENT DOCUMENTS

| | | | |
|---|---|---|---|
| 3,676,969 | 7/1972 | Moore . | |
| 3,740,914 | 6/1973 | Arnaiz Diez . | |
| 3,775,925 | 12/1973 | Fujita . | |
| 3,797,179 | 3/1974 | Jackson . | |
| 3,873,225 | 3/1975 | Jakobsen . | |
| 3,899,855 | 8/1975 | Gadsby . | |
| 3,977,141 | 8/1976 | Peters . | |
| 4,034,528 | 7/1977 | Sanders et al. . | |
| 4,065,899 | 1/1978 | Kirkuff . | |
| 4,107,896 | 8/1978 | Wetzel . | |
| 4,130,974 | 12/1978 | Chalmers et al. . | |
| 4,185,939 | 1/1980 | Barth et al. . | |
| 4,279,106 | 7/1981 | Gleason et al. . | |
| 4,372,090 | 2/1983 | Shichijo | 52/542 X |
| 4,468,909 | 9/1984 | Eaton . | |
| 4,506,483 | 3/1985 | Phalen, Jr. . | |
| 4,527,374 | 7/1985 | Corbin . | |
| 4,535,579 | 8/1985 | Burgoyne et al. . | |
| 4,574,536 | 3/1986 | Bamber et al. . | |
| 4,731,969 | 3/1988 | Baker et al. . | |
| 4,738,068 | 4/1988 | Mendez . | |
| 4,752,520 | 6/1988 | Franklin . | |
| 4,890,432 | 1/1990 | Shepherd . | |
| 4,899,514 | 2/1990 | Brookhart, Jr. . | |
| 4,932,184 | 6/1990 | Waller | 52/535 |
| 5,070,671 | 12/1991 | Fifield et al. . | |
| 5,174,092 | 12/1992 | Naden . | |
| 5,210,989 | 5/1993 | Jakel | 52/518 |
| 5,214,895 | 6/1993 | Fifield . | |
| 5,268,028 | 12/1993 | Fifield . | |
| 5,295,339 | 3/1994 | Manner . | |
| 5,395,442 | 3/1995 | Dunton et al. . | |
| 5,406,766 | 4/1995 | Nicholas et al. . | |
| 5,465,547 | 11/1995 | Jakel | 52/518 |
| 5,490,360 | 2/1996 | Fifield et al. . | |
| 5,502,940 | 4/1996 | Fifield . | |
| 5,603,758 | 2/1997 | Schreifels, Jr. et al. . | |

METHOD AND APPARATUS FOR MANUFACTURING AND INSTALLING ROOF TILES HAVING IMPROVED STRENGTH AND STACKING FEATURES

CROSS-REFERENCE TO EARLIER APPLICATIONS

This application is a continuation-in-part application to U.S. patent application Ser. No 08/711,042 filed Sep. 10, 1996, and is also a continuation-in-part application to U.S. patent application Ser. No. 29/072,246 filed Jun. 10, 1997, now abandoned. This application also claims priority based on provisional application no 60/073,273 filed Jan. 30, 1998.

TECHNICAL FIELD

This invention relates in general to roofing, and particularly relates to the use of light weight yet structurally sound clay roof tile to simulate wood shake roofing, in a stacking configuration which includes cutting indicia to facilitate the stacking of the tile in a manner which discourages pattern repetition.

BACKGROUND OF THE INVENTION

In the field of roofing, it is well known to provide wood shakes, as roofing elements, in an overlapping manner for water diversion purposes. However, as may be understood, such wood shakes can have disadvantages, not least of which is their flammability. Furthermore, after sufficient weathering such wood shakes can tend to leak. However, consumers nevertheless have shown a preference towards such wood shakes, due to their desirable appearance.

Therefore, it has become known to provide simulated roof members, which simulate wood shakes but are comprised of nonflammable materials. However, such approaches nevertheless have disadvantages when used with materials other than wood.

When done with concrete, the material is typically cast in a lower mold only. The only contours possible on the upper surface are those created by the linear planing off of the wet material immediately after pouring, which can be limiting. Metal pressed products tend to be limited to shapes with identical contours on both top and bottom surfaces.

Other disadvantages can also become apparent if mass-produced simulation shakes are provided. In order to achieve a more realistic installed appearance, it is necessary to stagger the horizontal courses so that the edges of two adjacent horizontal courses do not align, both from a standpoint of appearance and for water drainage. To achieve this, it is known in the art that the first tile on the right end of each course (assuming that the tiles are being installed right to left) should be cut of a random length to create the desired random stagger. However, without the proper guidance (or incentive), installers will frequently create an unintentional and unwanted pattern, the most common of which is known in the art as "stair stepping".

Therefore, it may be seen that there is a recognized need in the art to provide simulated wood shakes, which include improved weathering and strength capabilities, but can still be installed to provide a realistic appearance without recognized stacking patterns.

SUMMARY OF THE INVENTION

The present invention overcomes deficiencies of the prior art by providing an improved tile, and method and apparatus for providing same, which includes improved structural capabilities, yet simulates a wood shake construction.

Therefore, it is an object of the present invention to provide an improved roof construction.

It is a further object of the present invention to provide an improved roof tile.

It is a further object of the present invention to provide an improved roof tile which has improved structural capabilities.

It is a further object of the present invention to provide an improved roof tile which is relatively light in weight.

It is a further object of the present invention to provide an improved roof tile which simulates a wood shake but is composed of vitrified clay.

It is a further object of the present invention to provide an improved roof tile which simulated a wood shake even when viewed from its "butt" edge.

It is a further object of the present invention to provide an improved roof tile laying systems.

Other objects, features, and advantages of the present invention will become apparent upon reading the following detailed description of the preferred embodiment of the invention when taken in conjunction with the drawing and the appended claims.

BRIEF DESCRIPTION OF THE DRAWINGS

In FIG. 5, a cut along dotted line 50 would be following the cut mark "5". FIG. 5 also shows the provision of three nail holes 19.

DETAILED DESCRIPTION OF THE PREFERRED EMBODIMENT

Overall Discussion

Generally described, the configuration, and method and apparatus for forming same, of the tiles according to the present invention is now generally discussed.

Figure 1:
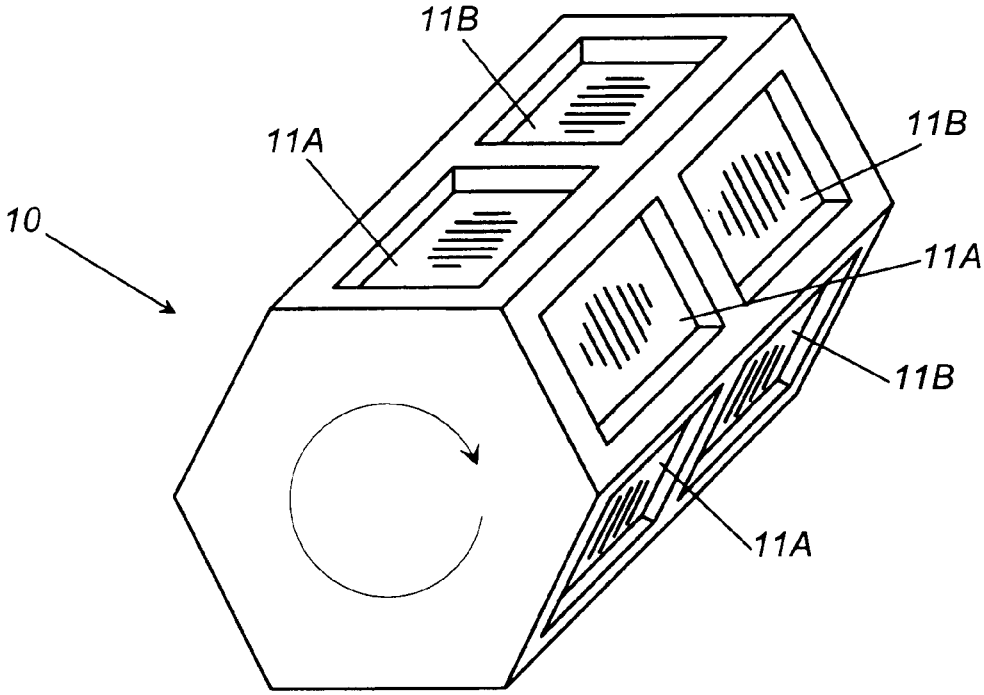
FIG. 1 is a pictorial view of a rotatable mold 10, including multiple tile-shaped cavities 11A, 11B for receiving clay.
Figure 2:
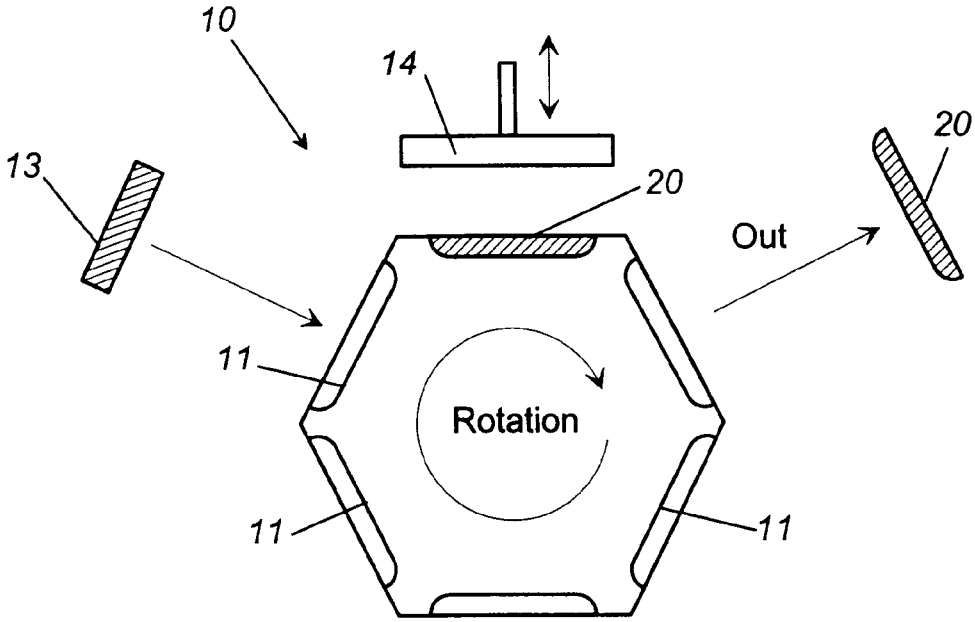
FIG. 2 is an illustrative end view of a mold 10 such as shown in FIG. 1, viewed along its axis of rotation and illustrating its interaction with a reciprocating top mold member 14, as it works with the base mold member 10 in converting clay bats 13 into tile forms which, upon further processing, will provide tile according to the present invention.
Figure 3A:
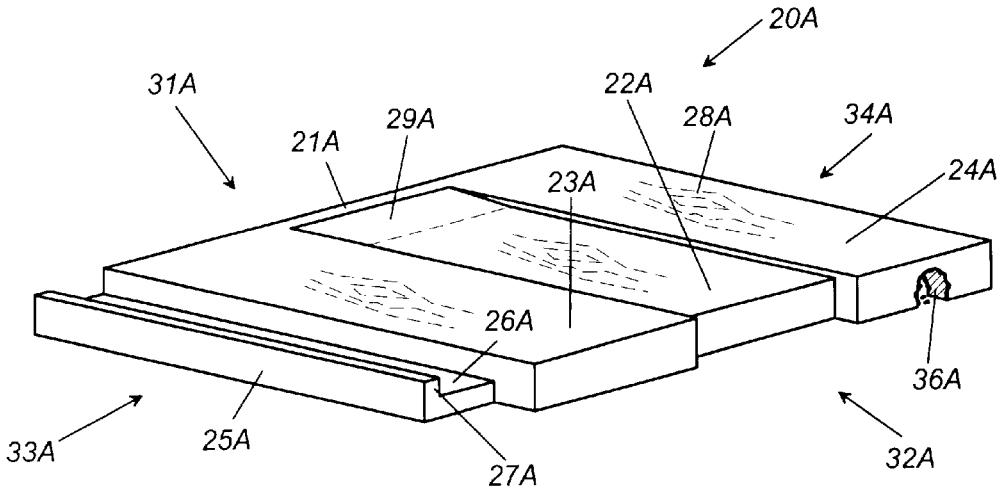
FIGS. 3*a* and 3*b* are pictorial views of "sister" tile configurations 20A, 20B, respectively.
Figure 3B:
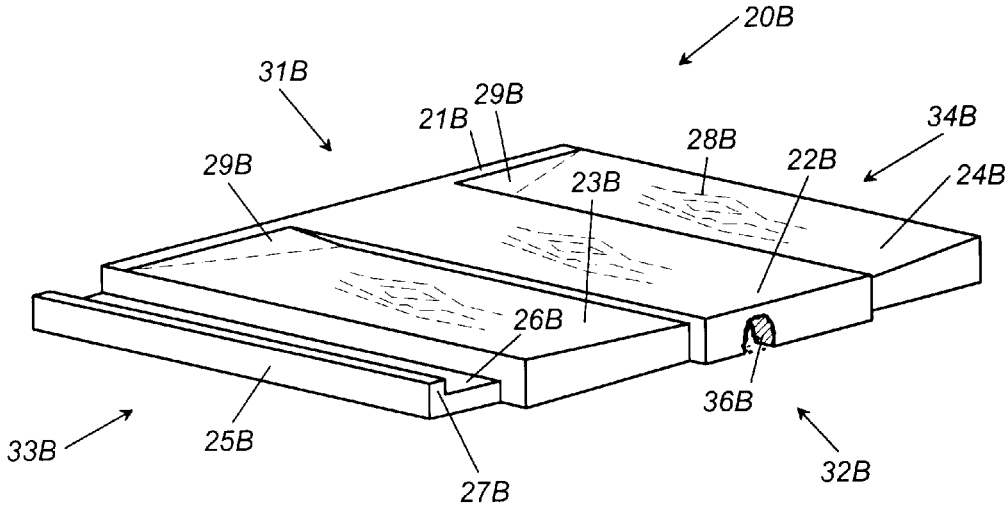
Figure 4:
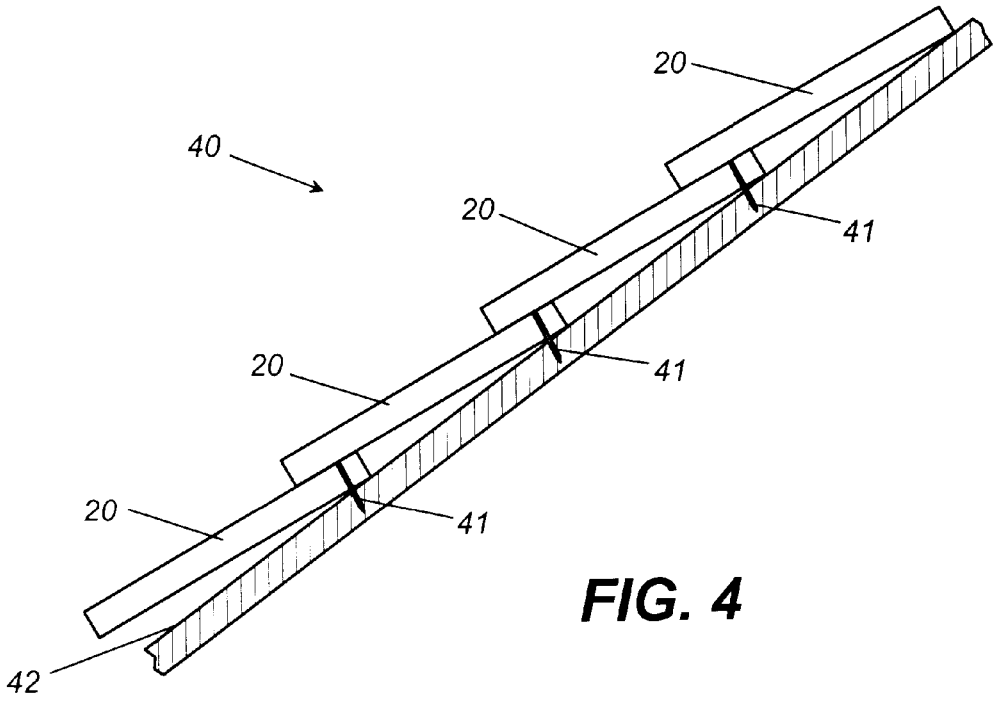
FIG. 4 is a side view illustrating the overlapping nature of the tiles 20 when they are installed atop a supporting surface 42, and secured thereon by nails or other suitable fasteners 41.
Figure 5:
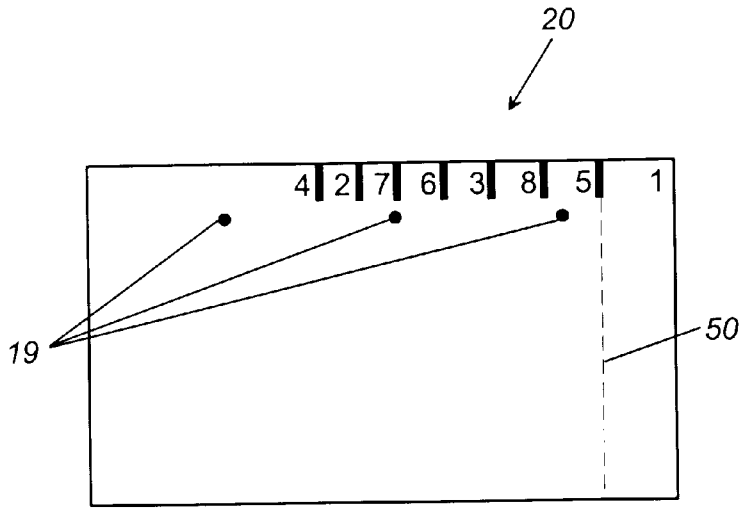
FIG. 5 is a top plan illustrative view of a "generic" tile 20 with cutting indicia molded therein which can be used to guide the installer to create a predetermined yet typically imperceptible stacking pattern.
Figure 6:
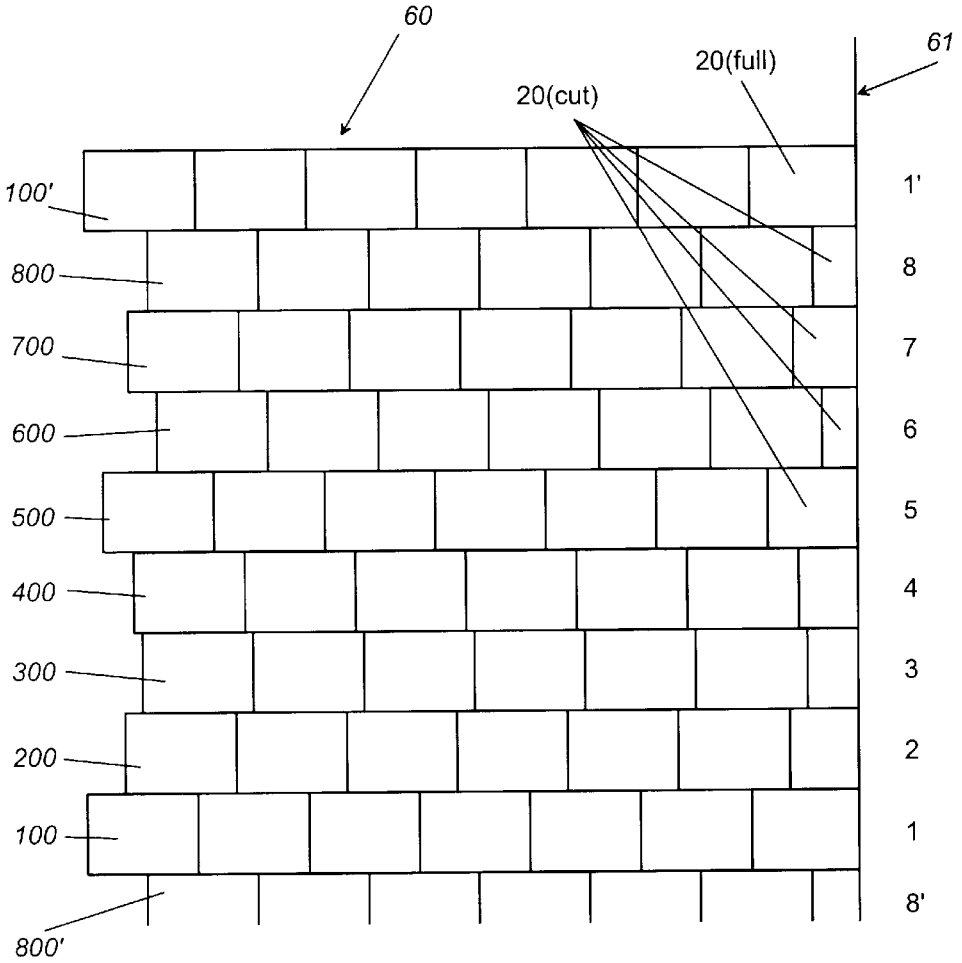
FIG. 6 is an illustrative view illustrating the stacking configuration according to the present invention, which although having a repetitive pattern, is substantially imperceptible to the typical human eye.

FIGS. 1 and 2 illustrate the general manufacturing process for providing tiles 20 according to the present invention, that being the use of rotating mold 10, which accepts clay bats 13 and forms them into tile shapes such as shown in FIGS. 3A and 3B. After being dried and kiln fired, these tiles can be installed in an overlapping manner as shown in FIG. 4 atop an inclined support surface such as 42. As shown in FIG. 5, "cut marks" or other suitable indicia are molded into the clay shapes such that, upon suitable cutting by a installer (not shown), they can be installed in the configuration such as shown in FIG. 6.

The Manufacturing Process

Reference is now made to FIGS. 1 and 2, which combine to illustrate the general concept according to the present invention of manufacturing tiles according to the present invention, by molding raw unmolded clay into two similar tile forms suitable for oven firing.

Clay with a moisture content sufficient to provide adequate plasticity (18–22% has been found acceptable) is extruded from a pugmill/extrusion machine in a column (not shown). As may be understood, the extrusion process evacuates substantially all of the air from the clay mixture to discourage delamination. The column is then cut into short lengths to create the blanks or "bats" 13 for pressing.

The press structure includes a rotatable drum 10 having a hexagonal cross-section and defining six outwardly-directed drum faces. Two (lower) molds are provided in on each drum face, totaling 12 molds. To provide an aesthetically pleasing variation on the installed appearance of the tiles (discussed in detail below), one "A" and one "B" mold cavity 11A, 11B is provided on each face. The net result is a 50—50 mix of the two profiles in production.

As shown in FIG. 2, the clay bats enter the press and are deposited on the lower molds when the molds are in the 10 o'clock position. The drum 10 is configured to rotate about a substantially horizontal axis, such that upon drum rotation the bats 13 are moved into the 12 o'clock position, where the top mold member 14 comes down and presses the bats into the shape of the tile, and then withdraws upwardly. The drum then rotates the pressed tile forms 20 to the "2 o'clock" position, where a vacuum picker (not shown) such as known in the art moves in and simultaneously trims off the excess clay around the edges of the tiles and punches nail holes as needed, It removes the tiles from the drum face and deposits them on drying trays (not shown) that are passed under the picker on a synchronized conveyor.

The wet tiles, on their individual dryer trays, are then sent through a dryer where the moisture content is reduced to less than 1%. The dry "greenware" is then transported to the kiln for firing. The vitrified tiles, in the forms shown in FIGS. 3A and 3B, are then placed directly into their shipping pallets.

The Tiles and Their Details

As noted above, the tiles according to the present invention are produced in a manner such as to provide a 50—50 production of two "sister" tile configurations, referenced at this point forward as 20A and 20B configurations. Each of these configurations is interchangeable within a stacking configuration described in further detail; however, the decorative upper surfaces are somewhat different in appearance. If the tiles are installed randomly, perceptibly repetitive patterns will be discouraged, especially if the tiles are installed as discussed below.

Reference is now made to FIGS. 3A and 3B, each of which illustrates a single tile 20A, 20B, respectively. As may be seen by these drawings, the upwardly directed face, as well as the butts of each of the tiles, contain abrupt changes in elevation and setback to simulate three (3) individual pieces of wood shake. These changes create the desired shadowing and appearance to simulate wood shakes.

Figure 7:
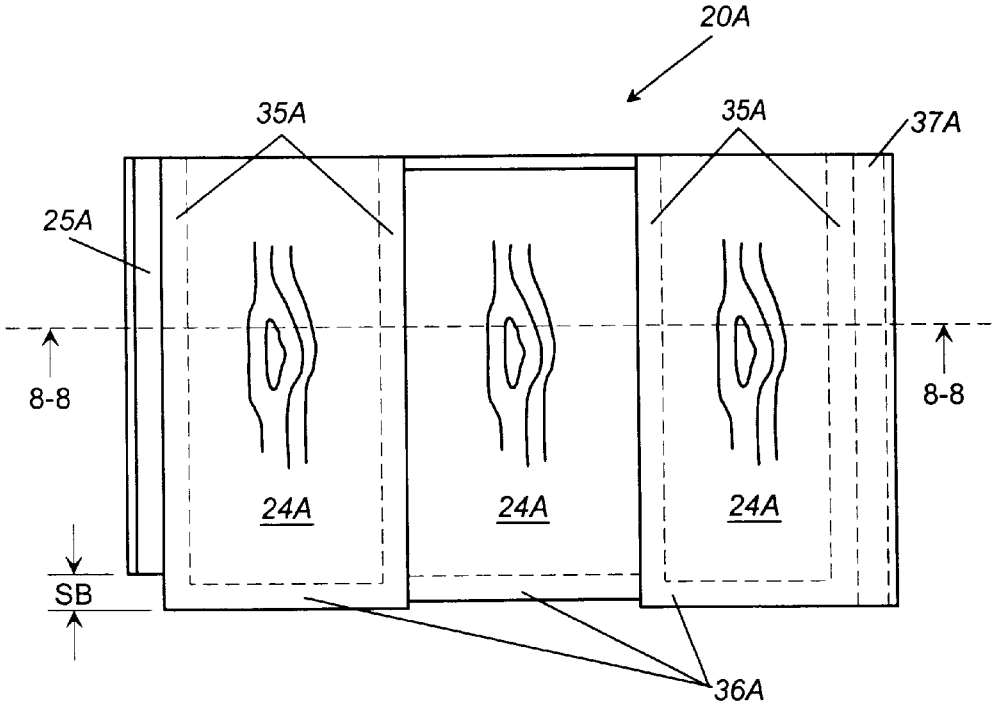
FIG. 7 is a top plan view of a tile configuration 20A according to the present invention.
Figure 8:
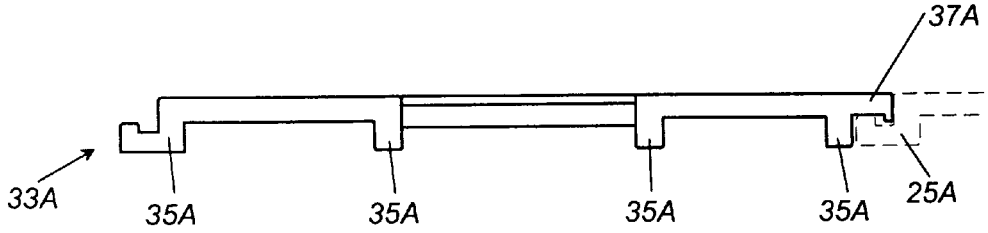
FIG. 8 is a cross-sectional view of the tile in FIG. 7, taken along line 8—8.

As shown in FIG. 3A, tile 20A includes a center section 22A, a "left" (as viewed from the butt end) section 23A, a right section 24A, and a sidewardly-extending engagement member 25A, which extends to the left of member 23A, and defines a channel 26A and includes an upwardly-directed ledge portion 27A. The tile 20A includes a "head" end 31A, a "butt" end 32A, a left edge 33, and a right edge 34. The sections 22A, 23A and 24A all include simulated woodgrain designs 28A, at their upper surfaces and at their butt edges, which gives each tile the appearance of three side-by-side conventional wood shake members, which in practice tend to have their upper surfaces at varying heights due to differences in shake thicknesses and other natural variances. In the tile 20A shown in FIG. 3A, the center member 22A is somewhat lower than its two adjacent members 23A, 24A, and includes an inclined portion 29B. The center portion 22A does not extend towards the "butt" end of the tile as much as its two adjacent members 23A, 24A, giving a "set-back" appearance, simulating installed wood shakes. Referring momentarily to FIGS. 7 and 8, the tile 20A also includes a downwardly-directed side engagement member 37A.

Figure 9:
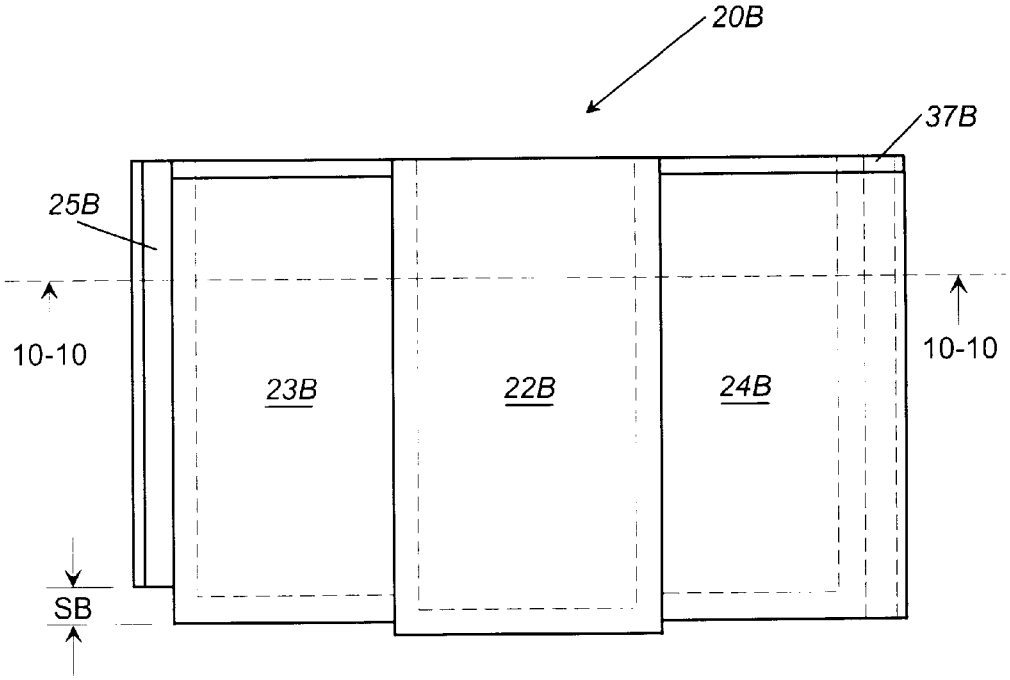
FIG. 9 is a top plan view of a tile 20*b* according to the present invention.
Figure 10:
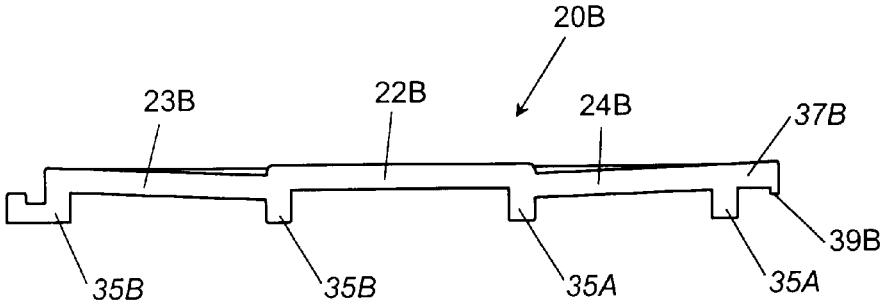
FIG. 10 is a cross-sectional view of the tile of FIG. 9, taken along line 10—10.
Figure 11:
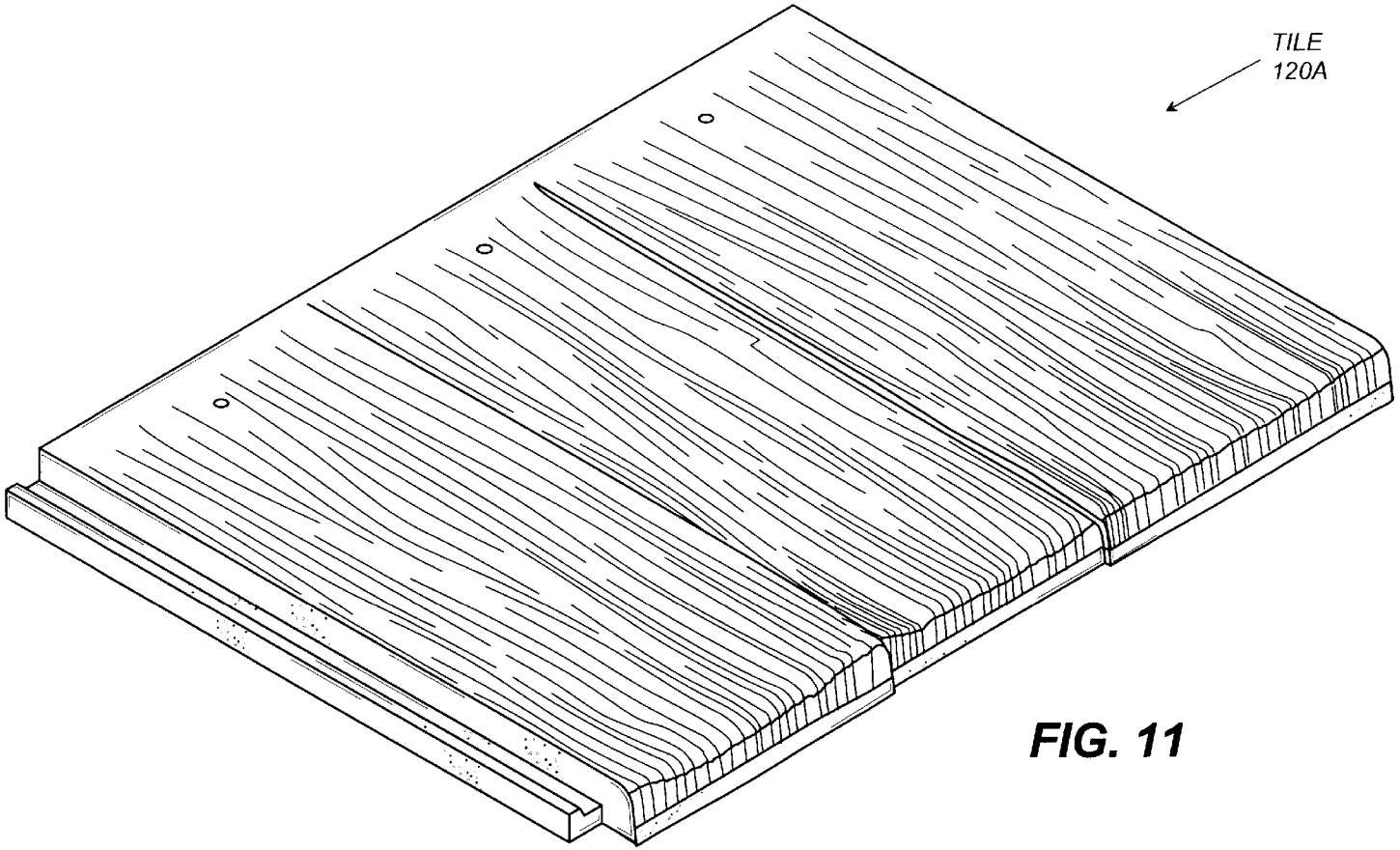
FIG. 11 is a perspective view of a tile 120A according to another embodiment of the present invention, with the center section depressed relative to the side sections.
Figure 12:
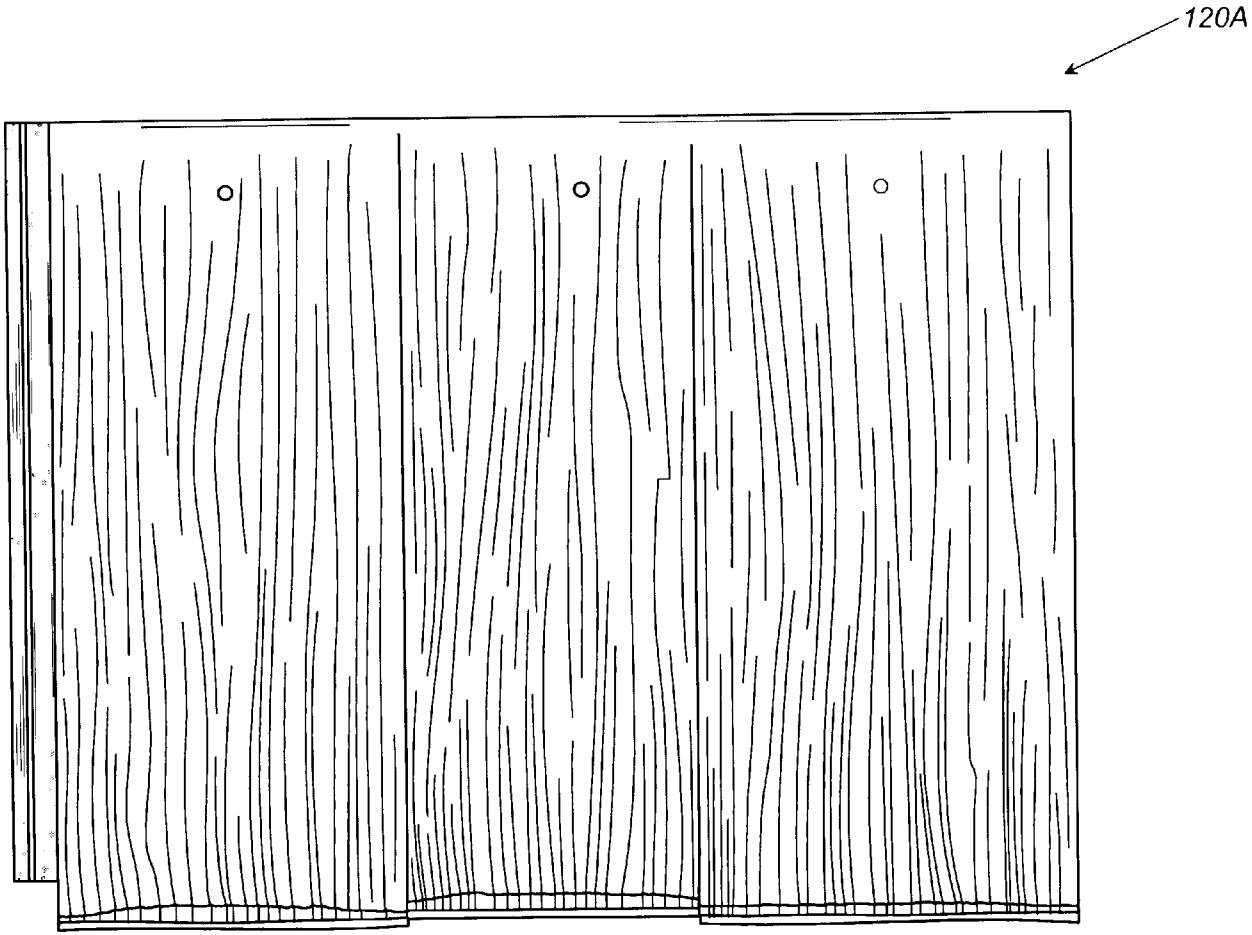
FIG. 12 is a top plan view of the tile 120A shown in FIG. 11.

Referring now to FIG. 3B, the tile 20B shown in that figure includes a center portion 22B, a left portion 23B, a right portion 24B, a sidewardly-extending upwardly-directed engagement member 25B (defining a channel 26B and including an upwardly-directed engagement ledge 27A). The tile 20B includes a head end 31B, a "butt" end 32B, a left edge 33B, and a right edge 34B. As in tile 20A, tile 20B includes the three members 22B, 23B, and 24B, which simulate three adjacent wood shakes. Inclined face portions 29B (two shown in FIG. 3B) compensate for the fact that the left section 23B, and the right section 24B each slope slightly towards the relatively higher center portion 22B. As in the case of tile 20A, tile 20B does not have an uniform "butt" edge, instead its section 22B extends outwardly somewhat relatively to its two adjacent sections 23B, 24B. As shown in FIGS. 9 and 10, tile 20B likewise include a sidewardly-extending downwardly-directed engagement member 37B, which includes a downwardly-directed drip ridge 39B, which extends the length of the member 37B. It should be noted that tile 20A likewise has a drip ridge, although it is not numbered in FIG. 8.

It may be understood that the sidewardly-extending interlocking members 25A, 25B, of the tile members allow for the interlocking of laterally adjacent tile members to form a horizontal course as discussed in detail below. It should also be noted that, as shown best in FIGS. 3A, 3B, 7 and 9, the interlocking members 25A, 25B, of the tiles 20A, 20B, respectively, are "set back" a distance "SB" (see FIGS. 7 and 9) from the butt ends of their adjacent sections 23A, 23B, respectively. This provides an improvement over the known prior art, as the "interlocking" interface illustrated in FIG. 8 (between the solid line downwardly-directed interlocking member 37A and the dotted-line member 35A) is "hidden" somewhat by the overhanging nature of the downwardly-directed interlocking member 37A.

An important attribute of this tile is that it is light in weight, as defined by the requirement of having an installed weight in the order of less than 6 pounds per square foot. In order to have the irregular contours of a wood shake, while also maintaining a uniform wall thickness to control unwanted additional weight, the bottom surfaces of the tiles are not solid like some prior art configurations, but instead include the use of strategically-placed structural ribs and a substantially consistent shelf thickness to provide a lightweight yet structurally sound tile configuration.

Reference is now made to FIGS. 7–10, which provides some further details regarding the configuration of the two top members 20A, 20B. As may be seen, in each of these configurations, a plurality of structural support ribs extend downwardly from what could be referred to as the main body or "shelf" of each of the tiles. Four of these structural support ribs 35 are substantially coparallel and are located to correspond with the highest points on the top of the tile. The provision of structural rib locations within the tile at locations immediately beneath the topmost "peaks" extending from top surface of the tiles provides superior strength when subjecting the tile to flexural strength testing or actual field conditions, where the tiles must support foot traffic. The remaining rib is a "butt" rib 36 which extends along the butt edge of each of the tiles. Unlike the coparallel ribs 35, which are each substantially straight, the butt ribs includes a number of "jogs" which correspond to the jogged nature of the butts of the tiles.

As discussed in further detail below, the tiles 20A, 20B are typically installed horizontally in interlocked courses, with each horizontal course overlapping the one immediately below it. The overlap is typically three (3) inches, although other overlap lengths are contemplated without departing from the spirit and scope of the present invention. Each of the tiles 20A, 20B, is designed so that the rear edge of the upper surface is both level and the highest elevation of the tile. This provides a level resting surface 21 (21A for tile 20A and 21B for tile 20B) for the structural support ribs of the overlapping tiles, discouraging unwanted rocking motion under load and minimizing any possible fulcrum points that might promote breakage. However, the gaps and shadows that are expected in a wood shake roof are maintained at the butts 32A, 32B, of the tiles, such that the two overlapping tiles have irregular clearance. As shown best in FIG. 10, the main "body" or "shelf" of the tile members includes a substantially consistent thickness. The side portions 23B, 24B of the tile 20B are of a substantially consistent thickness, yet taper towards the center of the tile, in order to divert as much water as possible from the joints that occur between adjacent tiles.

Reference is now made to FIG. 5, which generally illustrates the use of indicia placed on the tiles in the form of recessed slits extending a distance from the head end of the tiles. As discussed in detail later, such indicia facilitates perceptibly random lateral orientation of the horizontal courses relative to each other.

The Installation Process

In order to achieve a more realistic installed appearance, it is necessary to stagger the horizontal courses so that they do not appear to be have a regular spacing. To achieve this, it is known in the art that the first tile on the right end of each course (understanding that the tiles are installed right to left) should be cut of a random length to create the desired random stagger. However, left to their own devices, the installers will frequently create an unintentional and unwanted pattern, such as stair stepping.

To avoid this, as shown in FIG. 5, the present invention provides a plurality of numbered marks (eight in one preferred embodiment) on the upper edge of the tile to serve as a cutting guide just prior to the installation process. Although these marks (known generically as "indicia") are placed upon the top surface of the tile, they are concealed during the installation process by the overlap as shown in FIG. 4.

Reference is now made to both FIGS. 4 and 6, which combine to illustrate the tile installation or "stacking" process according to the present invention. In FIG. 4, the tile are overlapped as discussed above, and attached to a supporting surface (such as plywood) by nails or other suitable fasteners.

Reference is now made specifically to FIG. 6. A course 100 of tiles 20 begins with a full uncut tile 20 with its uncut right edge (corresponding to mark #1) aligned along the alignment edge line 61. The second course 200 is started with a tile cut on mark #2 and laid with its cut edge along the alignment edge line 61, the third course 300 with a tile cut on mark #3 and laid with its cut edge along the alignment edge line 61, and so on through the eighth course 800. Then the sequence is repeated. The numbers are placed to the left of the cutting mark so that they can be referenced when the installer returns to start the next course. This provides a predetermined yet random appearing pattern without the need of any printed diagram, measuring tools or the possibility of accidental unwanted patterns. Furthermore, this tends to discourage alignment of the side edges of the tiles, which is not preferred due to drainage reasons. One important feature of the invention is the provision of all the cutting marks to the right of the two leftmost coparallel structural ribs. This assures that at least two ribs will remain after cutting is complete, which will be recognized as advantageous in that stable tile placement is encouraged.

It may be understood that other layouts of cutting marks could also be practiced without departing from the spirit and scope of the present invention.

Embodiment Including Secondary Ribs

FIGS. 11–22 show an alternate tile configuration 120 which includes three shorter "secondary" ribs (200, 201, and 202) which add flexural strength, as additional material is added at the stressed locations. It also helps in the manufacturing process as the ribs have approximately the same maximum thickness as the maximum thickness of the tile, thus when the tile is freshly pressed and ejected from its mold, it prevents sagging while drying.

Figure 13:
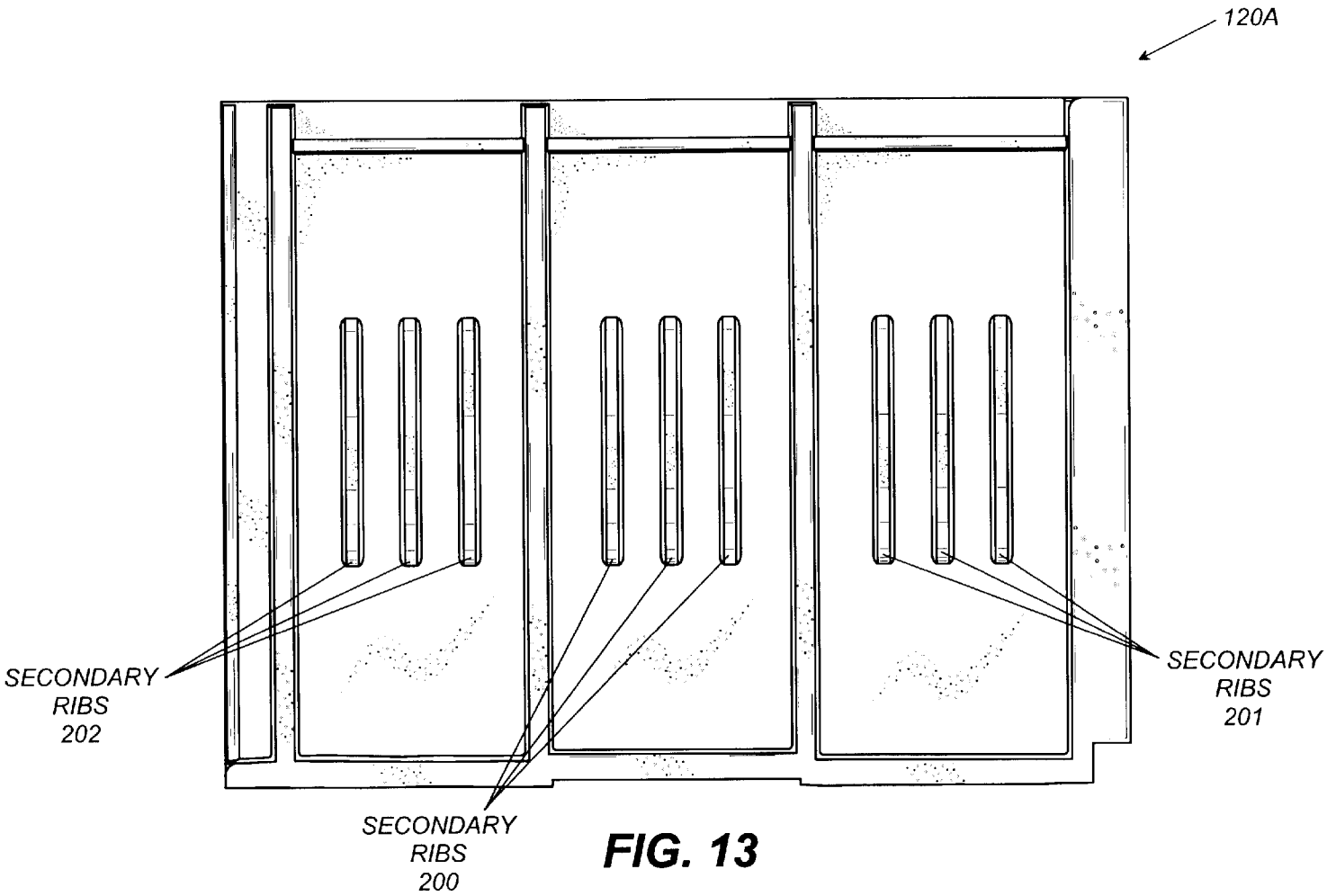
FIG. 13 is a bottom plan view of the tile embodiment 120A shown in FIG. 11.
Figure 14:
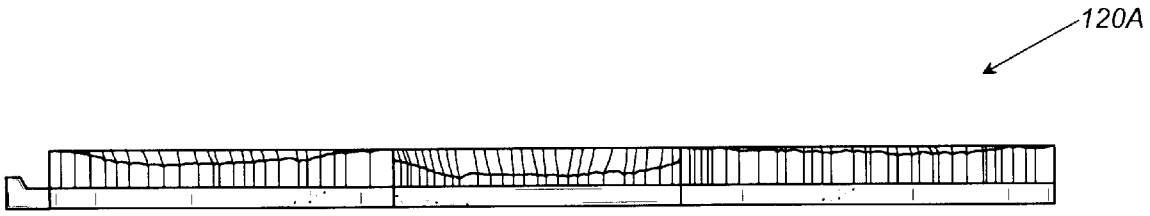
FIG. 14 is a front plan view of the tile embodiment 120A shown in FIG. 11.
Figure 15:
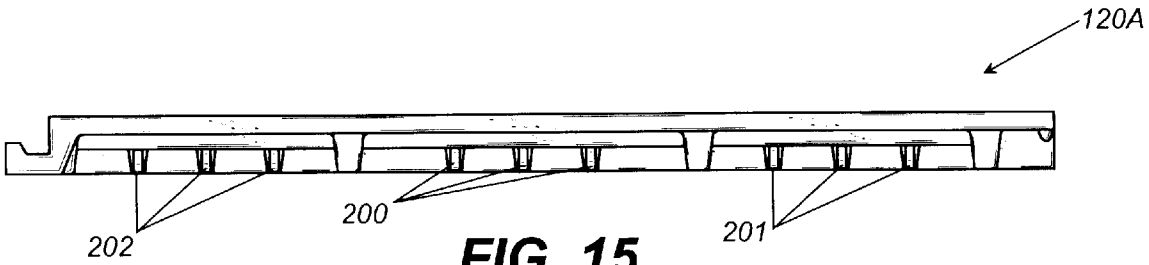
FIG. 15 is a rear plan view of the tile embodiment 120A shown in FIG. 11.
Figure 16:
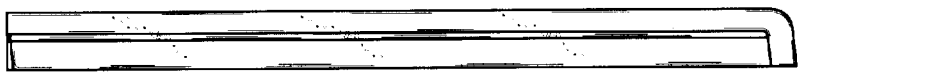
FIG. 16 is a right side plan view of the tile embodiment 120A shown in FIG. 11.
Figure 17:
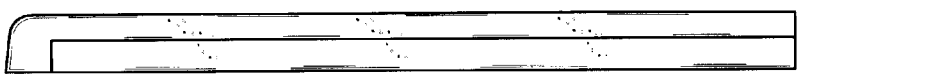
FIG. 17 is a left side plan view of the tile embodiment 120A shown in FIG. 11.
Figure 18:
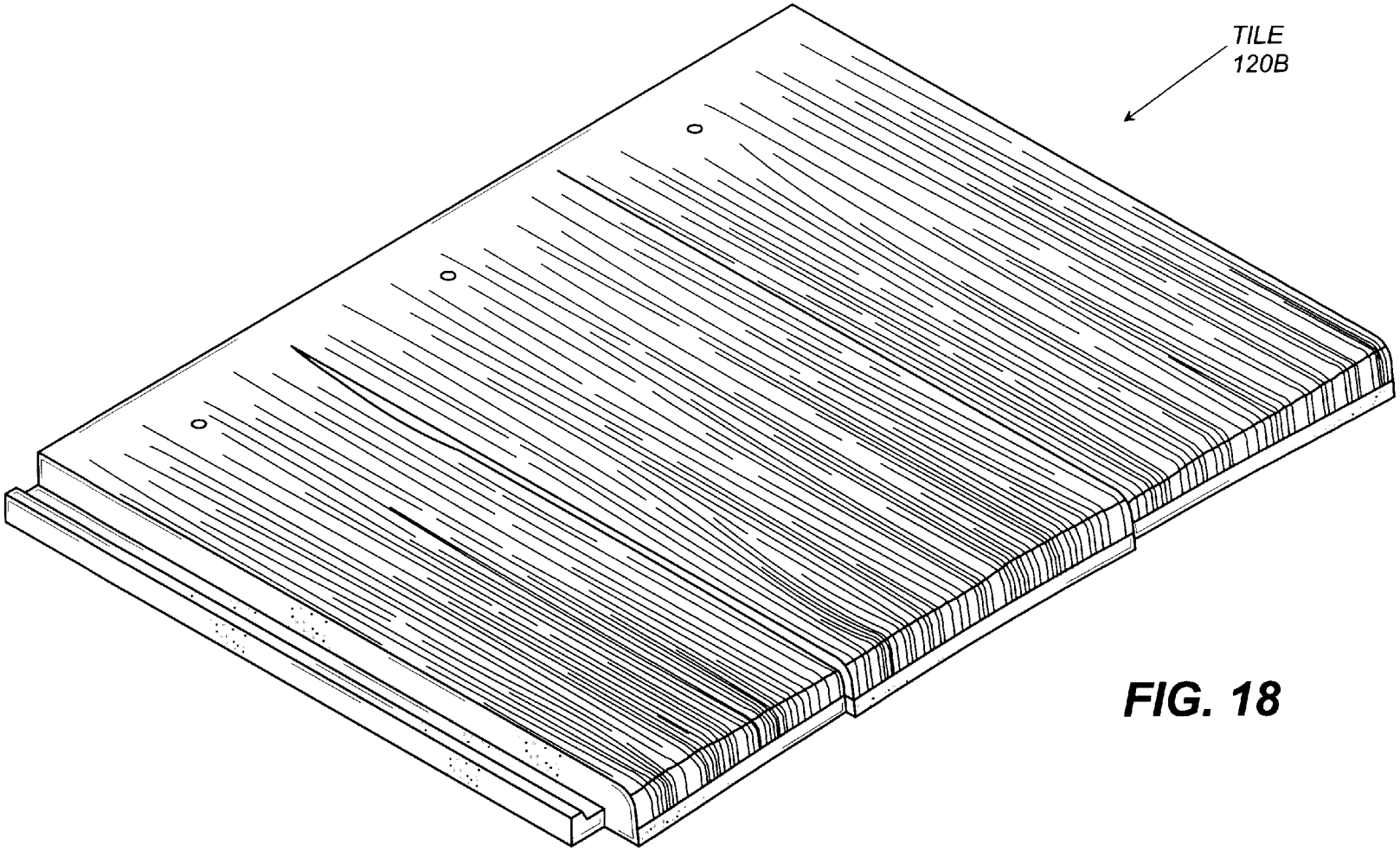
FIG. 18 is a pictorial view of a tile 120B according to another embodiment of the present invention, which is similar to that shown in FIGS. 11–18 but includes a raised center section relative to its two side sections.
Figure 19:
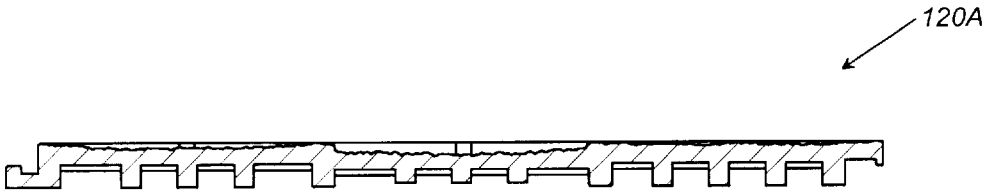
FIG. 19 is a cross-sectional view of the tile of FIG. 11, taken at approximately halfway up the tile at, as viewed from the "butt" end.
Figure 20:
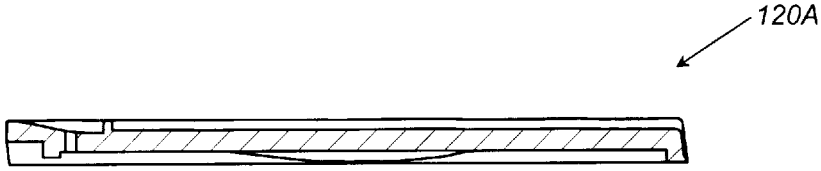
FIG. 20 is a cross-sectional view of the tile of FIG. 11, as viewed from the right side.
Figure 21:
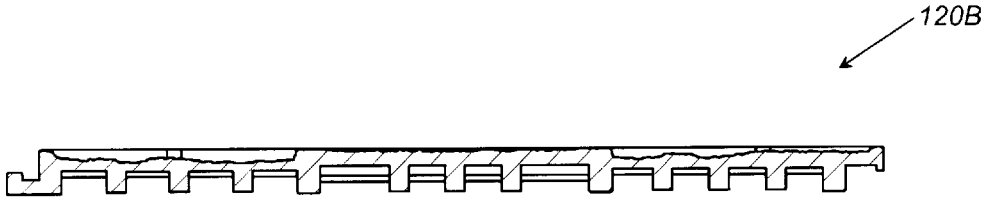
FIG. 21 is a cross-sectional view of the tile of FIG. 18, taken at approximately halfway up the tile at the center of the secondary ridges as viewed from the butt end.
Figure 22:
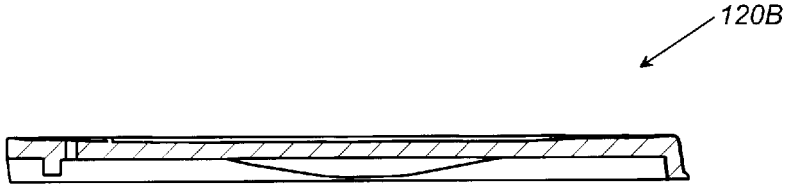
FIG. 22 is a cross-sectional view of the tile of FIG. 18, as viewed from the right side.

Referring now particularly to FIG. 13, three secondary ribs are provided between each adjacent pair of structural support ribs. Three ribs 200 are between the two centermost structural support ribs, three ribs 201 are one adjacent "gap" between structural support ribs and three ribs are in the other adjacent gap between structural support ribs.

As may be seen, the ramplike secondary ribs "ramp up" from each end towards the middle. In one configuration, the secondary ribs can have a flat spot on their thickest part, or their downwardly-facing faces can be curved from end to end.

The secondary ribs are substantially equally spaced intermediate each adjacent pair of structural ribs, although other spacings are contemplated.

Figure 25:
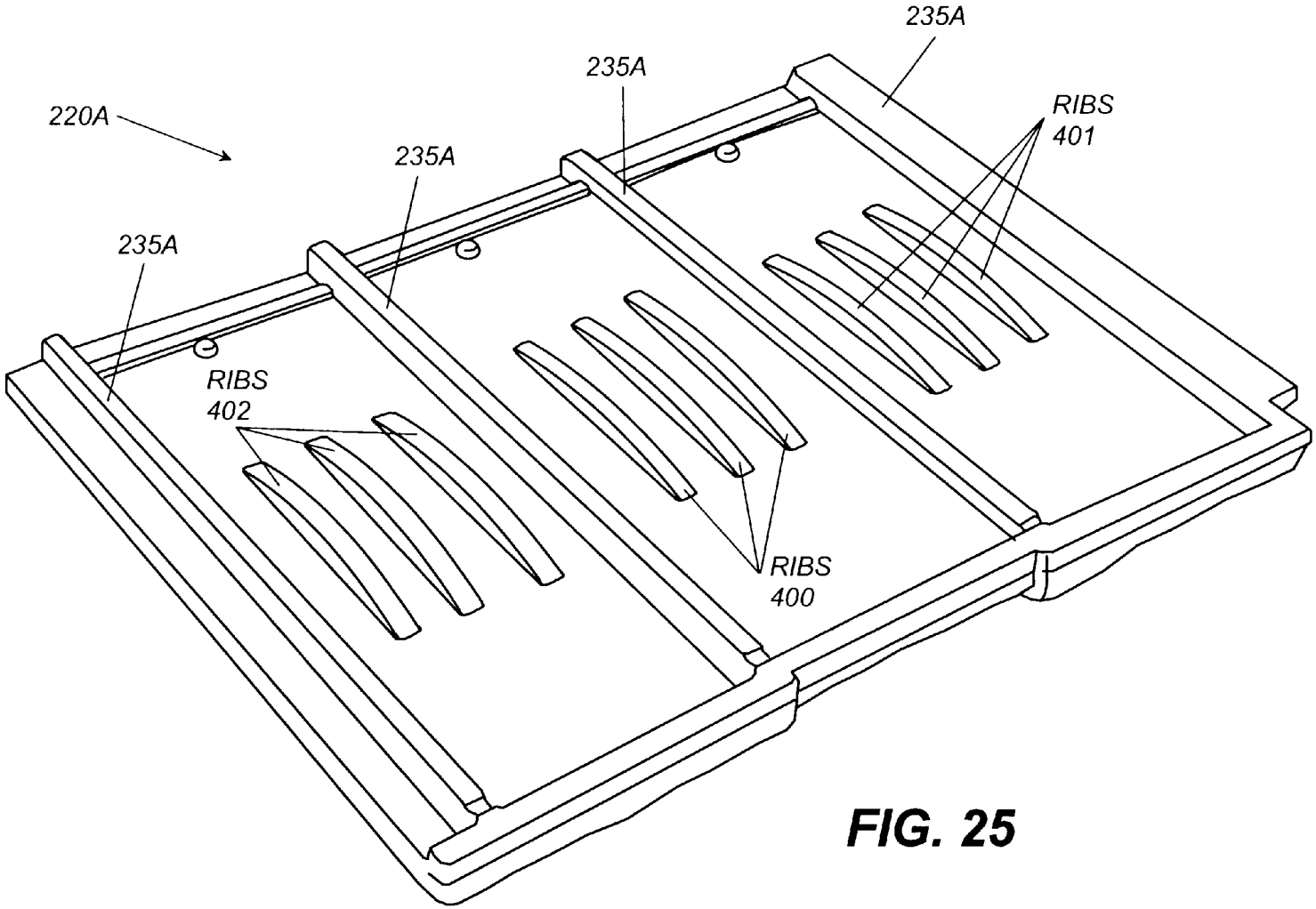
FIG. 25 is a bottom pictorial view of the tile embodiment of FIGS. 23–24, showing the secondary ribs 400, 401, and 402 on the underside of the tile.
Figure 26:
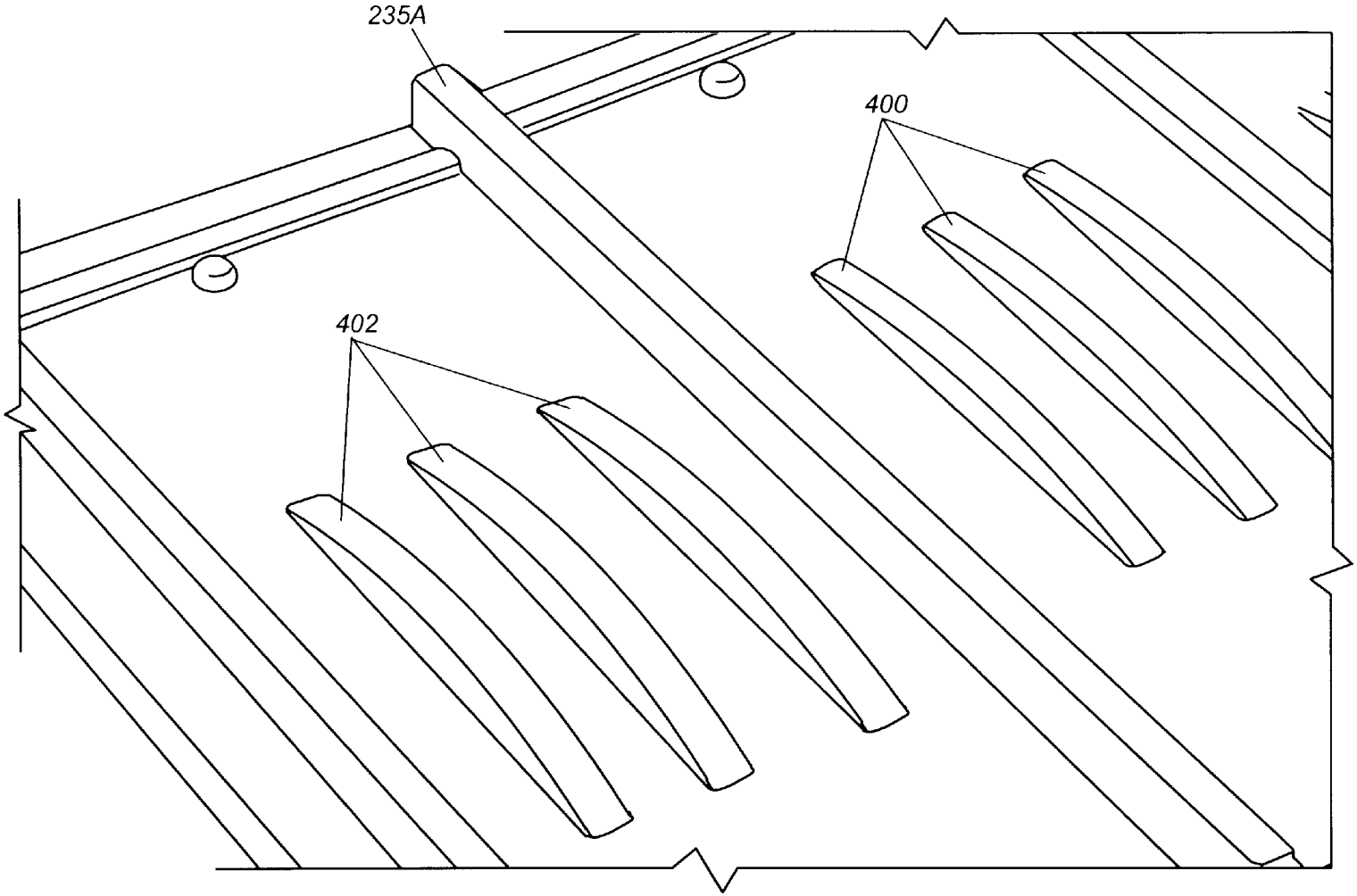
FIG. 26 is a partial close-up view of that shown in FIG. 25.

Reference is also briefly made to FIGS. 25–26, which show the use of secondary ribs 400, 401, and 402, which are used intermediate the primary ribs 235A.

Flexural Support Characteristics

One important feature of the invention shown in FIGS. 11–26 relates to the provision of tile configurations which provide improved flexural support characteristics as additional material is added where needed, at the secondary rib locations.

Manufacturing Advantages

Besides the provision of improved flexural support, the secondary ribs provide certain characteristics which provide for improved manufacturing characteristics.

As may be understood, when the tiles are initially produced, they are not completely solidified, and can sag in certain instances, especially in locations which include unsupported spans. The secondary ribs, if themselves supported, can provide support to prevent such sagging.

Therefore, as may be understood, the secondary ribs provide support for an otherwise unsupported horizontal portion.

Alternate Tile Body Embodiments

As may be understood, the three secondary ribs 200 in the middle portion of tile 120A are shorter than the secondary ribs 201, 202 in the two outer portions, due to the fact that the lower surface of the middle portion is closer to the intended support plane of the tile. However, it should be understood that such secondary ribs can also be used on the configuration of FIG. 18, in which the center section is higher than the outer two sections, and thus farther from the intended support plane of the tile.

Alternate Secondary Rib Embodiments

The secondary support ribs in the embodiments shown are used in groups of three; however, other alternative configurations including two or four or more are contemplated.

Top Support Ridges and Intermediate Gaps

As shown in FIGS. 23–26, an embodiment 220A is shown which includes the use of transverse upper support ridges 250, which are configured to provide stable support for tiles which are placed atop the ridges 250 in the next-laid course. It may be understood that the upper ridge edges of these ridges lie along a substantially common transverse axis, so that a "straight edge" of sorts is provided to lay next-course tile upon. This is particularly needed as the top surface of the tiles is quite irregular due to the imitation shake surface.

As may be seen, gaps 251 are also included, which allow for the passage of otherwise water flowing therebetween which would otherwise be barricaded by the ridges as the water flowed down the top (a.k.a. "upper") surface of the tile.

Figure 23:
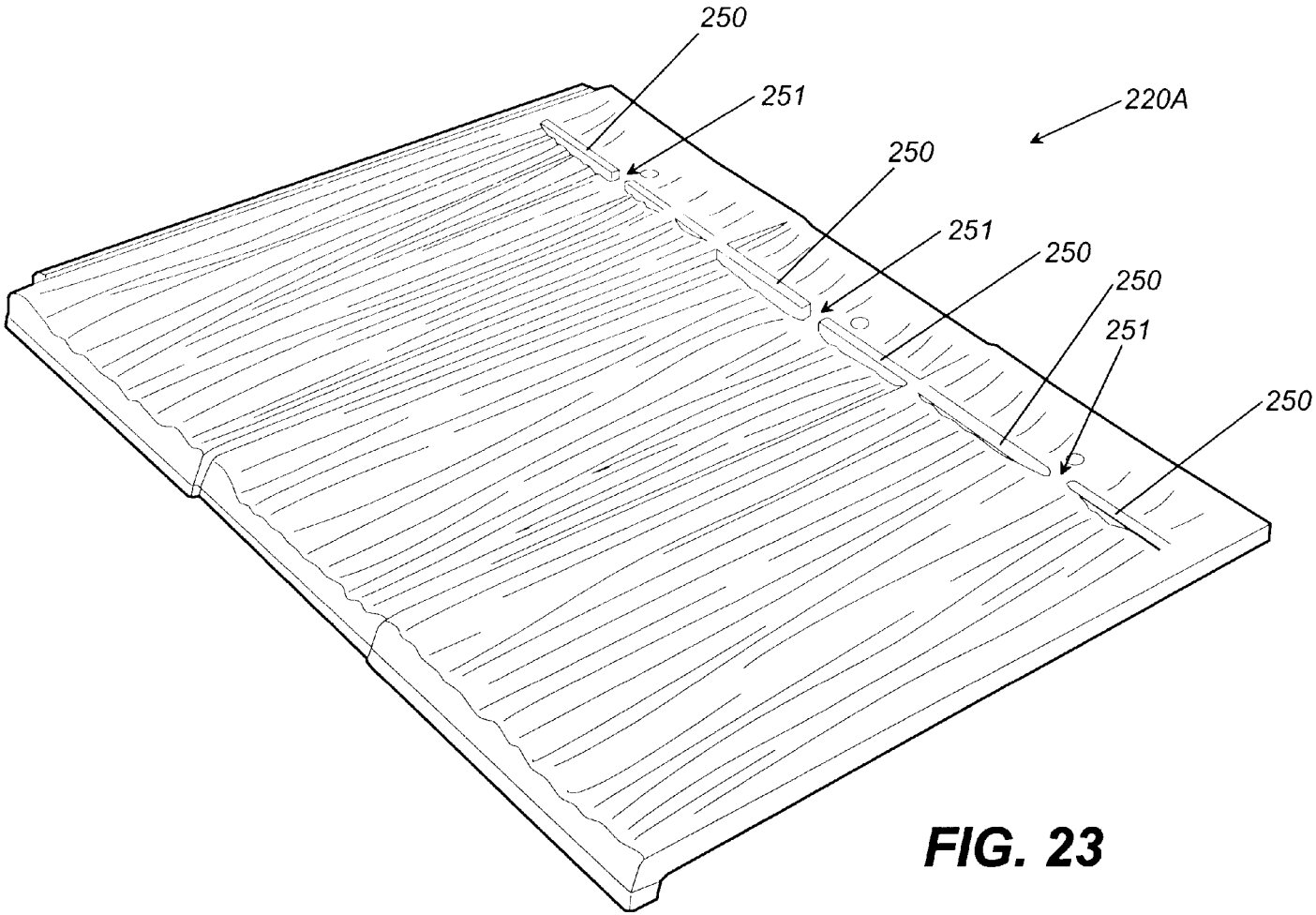
FIG. 23 is a top pictorial view of another tile embodiment 220A, which includes ridges 250 and gaps 251 not used in other tile configurations shown in this application.
Figure 24:
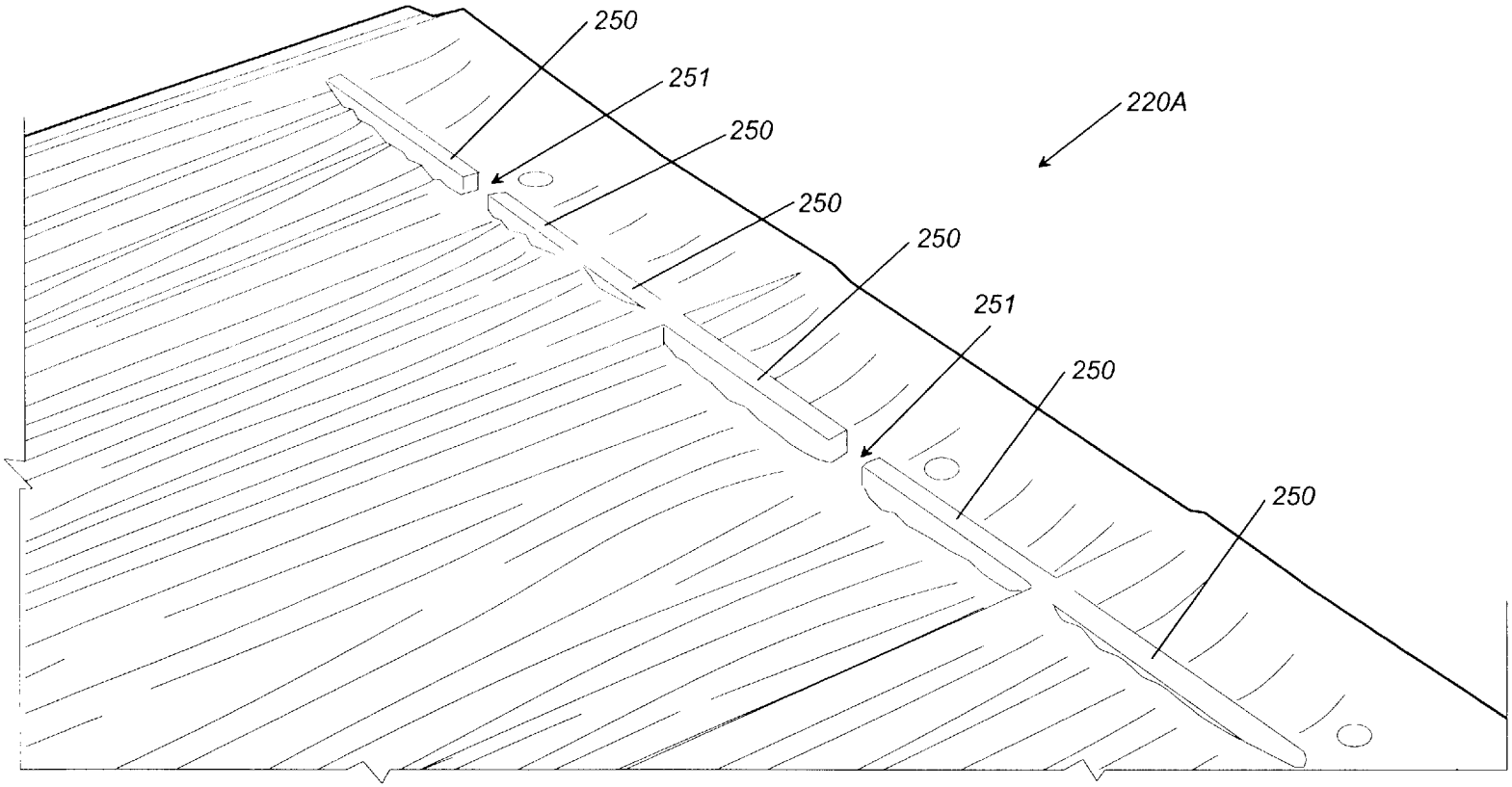
FIG. 24 is a partial close-up view of that shown in FIG. 23.

As shown in, for example, FIG. 23, the tile mounting means (which includes the area containing the three numbered dimples) is located in the body portion proximate the head end and located intermediate the head end and the axis of the ridges.

It may also be seen from FIGS. 23 and the tile includes a first upwardly directed face portion and a second upwardly-directed face portion. The first upwardly-directed face portion is configured to be substantially coplanar (within the limits of the irregular surface) to the second upwardly-directed face portion. As the first face portion is the portion intermediate the axis of the ridge portions and the head end of the tile, and the second face portion is the portion intermediate the ridge axis and the butt end of the tile, the ridge members are relatively below the first face portion (a.k.a. the "ridge axis") and above the second face portion when the tile is installed in its conventional inclined position.

Finally, it may be noted that the secondary ribs extend only a portion of the length of the tile body, whereas the primary ribs extend substantially the length of the body.

CONCLUSION

Therefore it may be seen that the present invention overcomes deficiencies in the prior art by providing a tile which can be produced in mass quantities, yet has the appearance of traditional wood shakes with the structural properties of fired clay. The present invention also provides an improved stacking configuration which allows for the use of a predetermined stacking pattern which nevertheless results in a stacked configuration which appears random to the typical observer.

While this invention has been described in specific detail with reference to the disclosed embodiments, it will be understood that many variations and modifications may be effected within the spirit and scope of the invention as described in the appended claims.

What is claimed is:

1. A tile having a head end and a butt end, said tile configured to be mounted atop a supporting surface, said tile comprising:

a body panel having a length, width, and having a predominantly upwardly-directed top face extending substantially along said length, said face having an irregular height;

at least one support ridge member extending transversely across said upwardly-directed surface, said ridge member defining at least one upper ridge edge substantially lying along a common ridge axis configured to support a second roof tile laid atop said ridge member;

a second support ridge member extending transversely across said upwardly-directed surface, said second ridge member defining a second upper ridge edge lying substantially along said common ridge axis and configured to support said second roof tile laid atop said first and second ridge members, said first and second ridge members spaced apart to define an intermediate gap therebetween, to allow water to drain therethrough while running down said upwardly-directed top face; and mounting means provided in said body portion proximate said head end and located intermediate said head end and said ridge axis.

2. The tile having a head end and a butt end as claimed in claim 1, wherein said upwardly-directed surface imitates a wood shake.

3. The tile having a head end and a butt end as claimed in claim 1, wherein said upwardly-directed surface simulates a plurality of side-by-side wood shakes.

4. The tile having a head end and a butt end as claimed in claim 2, wherein said plurality of side-by-side wood shakes includes three side-by-side wood shakes with a center shake having a height different than its adjacent neighbors.

5. A tile having a head and a butt end, said tile when installed on an inclined supporting surface comprising:

a body panel having a length and a width, said body panel also having a predominantly upwardly-directed top face extending substantially along said length, said face having an irregular height and including first and second upwardly-directed face portions being substantially coplanar, said first face portion terminating at said head end and being located above said second face portion; and first and second support ridge members extending transversely across said upwardly-directed surface and located below said first face portion and above said second face portion, said first and second support ridge members defining corresponding upper ridge edges both substantially lying along a common ridge axis configured to support a second roof tile laid atop said ridge member, said first and second ridge members also being spaced apart to define an intermediate gap therebetween, said gap defined at its deepest part to allow water to drain therethrough from said first upwardly-directed face portion to said second upwardly-directed face portion, while running down said upwardly-directed top face.

6. The tile having a head and a butt end as claimed in claim 5, wherein said gap is configured to provide a substantially continuous planar region connecting said first upwardly-directed face portion to said second upwardly-directed face portion.

7. A tile having a head and a butt end, said tile when installed on an inclined supporting surface comprising:

a body panel having a length and a width, said body panel also having a predominantly upwardly-directed top face extending substantially along said length, said face having an irregular height and including first and second upwardly-directed face portions being substantially coplanar, said first portion terminating at said head end; and first and second spaced-apart discrete support ridge members extending transversely across said upwardly-directed surface and located below said first face portion and above said second face portion, said first and second support ridge members defining substantially straight corresponding upper ridge edges both substantially lying along a common ridge axis configured to support a second roof tile laid atop said ridge member, said first and second ridge members also being spaced apart to define an intermediate gap therebetween, said gap defined at its deepest part to allow water to drain therethrough from said first upwardly-directed face portion down through said gap to said second upwardly-directed face portion, while running down said upwardly-directed top face.

* * * * *